US008586520B2

(12) United States Patent
Habeeb et al.

(10) Patent No.: US 8,586,520 B2
(45) **Date of Patent: *Nov. 19, 2013**

(54) METHOD OF IMPROVING POUR POINT OF LUBRICATING COMPOSITIONS CONTAINING POLYALKYLENE GLYCOL MONO ETHERS

(75) Inventors: Jacob Joseph Habeeb, Westfield, NJ (US); Dominick Nicholas Mazzone, Wenonah, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/534,194

(22) Filed: Jun. 27, 2012

(65) Prior Publication Data

US 2013/0005629 A1 Jan. 3, 2013

Related U.S. Application Data

(60) Provisional application No. 61/503,012, filed on Jun. 30, 2011, provisional application No. 61/503,001, filed on Jun. 30, 2011.

(51) Int. Cl.
*C10M 157/00* (2006.01)
*C10M 145/26* (2006.01)
*C10M 145/14* (2006.01)

(52) U.S. Cl.
USPC ..... 508/579; 508/469; 508/474

(58) Field of Classification Search
USPC ..... 508/100, 474, 579, 469, 577
See application file for complete search history.

(56) References Cited

U.S. PATENT DOCUMENTS

| | | | |
|---|---|---|---|
| 1,815,022 | A | 7/1931 | Davis |
| 2,015,748 | A | 10/1935 | Frolich |
| 2,191,498 | A | 2/1940 | Reiff |
| 2,387,501 | A | 10/1945 | Dietrich |
| 2,443,264 | A | 6/1948 | Mikeska |
| 2,471,115 | A | 5/1949 | Mikeska |
| 2,526,497 | A | 10/1950 | Mikeska |
| 2,591,577 | A | 4/1952 | McDermott |
| 2,655,479 | A | 10/1953 | Munday et al. |
| 2,666,746 | A | 1/1954 | Munday et al. |
| 2,719,125 | A | 9/1955 | Roberts |
| 2,719,126 | A | 9/1955 | Fields et al. |
| 2,721,877 | A | 10/1955 | Popkin et al. |
| 2,721,878 | A | 10/1955 | Popkin |
| 3,036,003 | A | 5/1962 | Verdol |
| 3,087,932 | A | 4/1963 | Little, Jr. |
| 3,087,936 | A | 4/1963 | LeSuer |
| 3,172,892 | A | 3/1965 | LeSuer et al. |
| 3,200,107 | A | 8/1965 | LeSuer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | LeSuer |
| 3,272,746 | A | 9/1966 | LeSuer et al. |
| 3,275,554 | A | 9/1966 | Wagenaar |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | LeSuer et al. |
| 3,382,291 | A | 5/1968 | Brennan |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | LeSuer et al. |
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |

(Continued)

FOREIGN PATENT DOCUMENTS

| | | | |
|---|---|---|---|
| CA | 1094044 | | 1/1981 |
| EP | 0045209 | B1 | 5/1983 |
| EP | 0355977 | | 7/1989 |
| EP | 0246612 | | 12/1990 |
| EP | 0524783 | | 7/1992 |
| EP | 0471071 | | 8/1995 |
| EP | 0989180 | A1 | 3/2000 |
| EP | 0819755 | B1 | 6/2001 |
| EP | 1247858 | A1 | 10/2002 |
| JP | 54159411 | | 12/1979 |
| JP | 61166892 | | 5/1994 |
| JP | 2006179888 | | 7/2006 |
| WO | 9826030 | | 6/1998 |
| WO | 9844022 | | 10/1998 |
| WO | 9947629 | | 9/1999 |
| WO | 9966013 | | 12/1999 |
| WO | 0023544 | | 4/2000 |
| WO | 2007011832 | | 1/2007 |
| WO | 2008094812 | A2 | 8/2008 |

OTHER PUBLICATIONS

Rodrigues, Ferdinand, Principles of Polymer Systems, Chapter 6, "The Molecular Weight of Polymers", McGraw-Hill Books, 1970, pp. 115-144.

*Primary Examiner* — Ellen McAvoy
*Assistant Examiner* — Vishal Vasisth
(74) *Attorney, Agent, or Firm* — Derek M. Kato; Robert A. Migliorini

(57) ABSTRACT

Provided is a method of improving the pour point of lubricating compositions comprising in admixture a base stock selected from the group consisting of Group I, Group II, Group III, Group IV and Group V base stocks, or any combination thereof, one or more polyalkylene glycol mono ethers and one or more pour point depressant by premixing at least one polyalkylene glycol mono ether with at least one pour point depressant prior to blending the premixed polyalkylene glycol mono ethers and pour point depressant with the base stock.

7 Claims, No Drawings

(56) References Cited

U.S. PATENT DOCUMENTS

| | | | |
|---|---|---|---|
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller et al. |
| 3,756,953 | A | 9/1973 | Piasek et al. |
| 3,769,363 | A | 10/1973 | Brennan |
| 3,770,854 | A | 11/1973 | Morris et al. |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,876,720 | A | 4/1975 | Heilman et al. |
| 3,948,800 | A | 4/1976 | Meinhardt |
| 4,100,082 | A | 7/1978 | Clason et al. |
| 4,149,178 | A | 4/1979 | Estes |
| 4,218,330 | A | 8/1980 | Shubkin |
| 4,234,435 | A | 11/1980 | Meinhardt et al. |
| 4,239,930 | A | 12/1980 | Allphin et al. |
| 4,367,352 | A | 1/1983 | Watts, Jr. et al. |
| 4,413,156 | A | 11/1983 | Watts, Jr. et al. |
| 4,426,305 | A | 1/1984 | Malec |
| 4,434,408 | A | 2/1984 | Baba et al. |
| 4,454,059 | A | 6/1984 | Pindar et al. |
| 4,501,678 | A | 2/1985 | Katayama et al. |
| 4,659,335 | A | 4/1987 | Wegner et al. |
| 4,747,851 | A | 5/1988 | Sung et al. |
| 4,758,362 | A | 7/1988 | Butke |
| 4,767,551 | A | 8/1988 | Hunt et al. |
| 4,798,684 | A | 1/1989 | Salomon |
| 4,906,350 | A | 3/1990 | Lucien et al. |
| 4,910,355 | A | 3/1990 | Shubkin et al. |
| 4,941,984 | A | 7/1990 | Chamberlain, III et al. |
| 4,956,122 | A | 9/1990 | Watts et al. |
| 4,973,414 | A | 11/1990 | Nerger et al. |
| 5,024,678 | A | 6/1991 | Mertens-Gottselig et al. |
| 5,034,141 | A | 7/1991 | Beltzer et al. |
| 5,034,142 | A | 7/1991 | Habeeb et al. |
| 5,068,487 | A | 11/1991 | Theriot |
| 5,075,269 | A | 12/1991 | Degnan et al. |
| 5,084,197 | A | 1/1992 | Galic et al. |
| 5,213,585 | A | 5/1993 | Oppenlaender et al. |
| 5,382,739 | A | 1/1995 | Atkins et al. |
| 5,443,755 | A | 8/1995 | Namekawa et al. |
| 5,599,100 | A | 2/1997 | Jackson et al. |
| 5,693,598 | A | 12/1997 | Abraham et al. |
| 5,705,458 | A | 1/1998 | Roby et al. |
| 5,746,933 | A | 5/1998 | Ishida et al. |
| 5,789,490 | A | 8/1998 | Chang |
| 5,824,627 | A | 10/1998 | McConnachie et al. |
| 5,837,657 | A | 11/1998 | Fang et al. |
| 5,906,968 | A | 5/1999 | McConnachie et al. |
| 6,010,987 | A | 1/2000 | Stiefel et al. |
| 6,034,039 | A | 3/2000 | Gomes et al. |
| 6,080,301 | A | 6/2000 | Berlowitz et al. |
| 6,087,307 | A | 7/2000 | Kaminski et al. |
| 6,090,989 | A | 7/2000 | Trewella et al. |
| 6,110,878 | A | 8/2000 | McConnachie et al. |
| 6,143,701 | A | 11/2000 | Boffa |
| 6,153,564 | A | 11/2000 | Arunasalam et al. |
| 6,165,949 | A | 12/2000 | Berlowitz et al. |
| 6,232,276 | B1 | 5/2001 | Stiefel et al. |
| 6,403,541 | B1 * | 6/2002 | Kambara et al. ..... 508/579 |
| 6,569,820 | B2 | 5/2003 | McConnachie et al. |
| 6,689,725 | B1 | 2/2004 | Gao |
| 6,730,638 | B2 | 5/2004 | Farng et al. |
| 6,734,150 | B2 | 5/2004 | Gao et al. |
| 2003/0104951 | A1 | 6/2003 | Rajewski et al. |
| 2005/0215441 | A1 | 9/2005 | Mackney et al. |
| 2009/0036725 | A1 | 2/2009 | Wu et al. |
| 2009/0107035 | A1 | 4/2009 | Leung |
| 2010/0004151 | A1 | 1/2010 | Bush |
| 2010/0093572 | A1 | 4/2010 | Paquette et al. |

* cited by examiner

METHOD OF IMPROVING POUR POINT OF LUBRICATING COMPOSITIONS CONTAINING POLYALKYLENE GLYCOL MONO ETHERS

CROSS-REFERENCE TO RELATED APPLICATIONS

This application claims priority to U.S. Provisional Ser. No. 61/503,012 filed Jun. 30, 2011, herein incorporated by reference in its entirety. This application further claims priority to related U.S. Ser. No. 61/503,001 filed Jun. 30, 2011, herein incorporated by reference in its entirety, as well as the non-provisional application filed on even date herewith and claiming priority thereto, being additionally incorporated by reference herein in its entirety.

FIELD

The present disclosure relates to methods of improving the pour point of lubricating compositions comprising a base stock selected from the group consisting of Group I, Group II, Group III, Group IV and Group V base stocks, or any combination thereof, one or more polyalkylene glycol mono ethers and one or more pour point depressants by premixing at least one polyalkylene glycol mono ether with at least one pour point depressant prior to blending the premixed polyalkylene glycol mono ethers and pour point depressants with the base stock.

BACKGROUND

Lubricant fuel/energy efficiency will be an important feature for future automotive engine lubricants and commercial vehicle engine lubricants. For automotive engine lubricant formulations, it is generally preferred to have lower viscosity fluids, e.g., below about 15 cSt at 100° C. Lower viscosity is known to impart lower viscous drag thus offering better energy efficiency or fuel economy. It is also important to have a lubricant formulation with a low friction coefficient. Fluids with low friction coefficients exhibit low frictional loss during lubrication. Low frictional loss is important for improved fuel or energy efficiency of formulated lubricants. Moreover, improved antiwear properties and film thickness are beneficial for increasing the lifetime of engine components. Another important property for engine lubricants is low pour point.

Polyalkylene glycol (PAG) fluids have been employed as lubricant base stocks. PAG fluids possess performance advantages that provide good efficiency, including very low friction/traction for energy efficiency and good lubricity (in hydrodynamic, mix, and boundary lubrication conditions). PAG fluids also have other desirable properties, including high viscosity index (VI), low pour point, and excellent cleanliness. PAG fluids, however, have numerous drawbacks, including lack of miscibility and compatibility with mineral and synthetic hydrocarbon-based lubricants. This has limited their use in conjunction with such base stocks. PAG fluids are also polar and highly soluble in water, which can result in severe corrosion problems. Moreover, the formulation or additive response of PAG fluids can be unpredictable, rendering them difficult to formulate with.

Polyethylene glycol, polypropylene glycol and polybutylene glycol, for example, are PAG fluids that are soluble in water, but very slightly soluble (e.g., less than about 0.1 wt % at 23° C.) in mineral and synthetic hydrocarbon-based base stocks. Each of these PAG fluids contains two OH groups which may contribute to their reduced solubility in non-polar solvents such as hydrocarbon-based base stocks.

As an example of a PAG, the structure of polyethylene glycol is shown by the following formula:

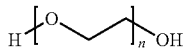

L. Rudnick and R. Shubkin, in Synthetic Lubricants and High-Performance Functional Fluids (2d Ed. 1999), Chapter 6, Polyalkylene Glycols, pp. 159-193 ("Rudnick"), describe polyalkylene glycols and their use as lubricants. Rudnick describes types of polyalkylene glycols used commercially as lubricants including, among others, "[h]omopolymers of propylene oxide (polypropylene glycols), which are the water-insoluble type" and "show limited solubility in oil", such as "monobutyl ethers" (p. 163). Rudnick also describes "[c]opolymers of ethylene oxide and propylene oxide, which are the water-soluble type" and "are typically diols or monobutyl ethers" (p. 163). Rudnick also describes "[p]olymers of butylene oxide [which] show greater oil solubility than the homopolymers of propylene oxide," "[p]olymers of propylene oxide and higher epoxides designed to give greater oil solubility" and "[p]olymers of propylene oxide that are dimethyl ethers" (p. 164). Other references which discuss polyalkylene glycols and related compounds are: U.S. Pat. Nos. 4,973,414, 5,024,678, 5,599,100, 5,746,933, 6,087,307, U.S. 2003/0104951, U.S. 2009/0107035, U.S. 2010/0004151, U.S. 2010/0093572, EP 355 977, EP 524 783, EP 246 612A, WO 2000/23544, JP 54159411A, JP 61166892, JP 6179888, JP 6128580.

It would be desirable to have mineral and synthetic hydrocarbon-based lubricant compositions that take advantage of the desirable qualities of PAG fluids, including their good frictional properties, high VI and cleanliness, while overcoming their drawbacks, including the lack of miscibility of PAG fluids with mineral and synthetic hydrocarbon-based lubricants and unpredictable additive response. It would also be desirable to improve the pour point of such lubricant compositions.

SUMMARY

This invention relates to a method of improving the pour point of a lubricating compositions comprising a base stock selected from the group consisting of Group I, Group II, Group III, Group IV and Group V base stocks, or any combination thereof, one or more polyalkylene glycol mono ethers, and one or more pour point depressants, by premixing at least one polyalkylene glycol mono ether with at least one pour point depressant prior to blending together or admixing the premixed polyalkylene glycol mono ethers and pour point depressants with the base stock.

In one embodiment, the polyalkylene glycol mono ethers are represented by the formula:

$$R_1\text{-}[\text{-}O(R_2)\text{-}]_n\text{-}OH$$

wherein $R_1$=$C_1$ to $C_{12}$ and may be linear or branched; $R_2$=$C_1$ to $C_6$ and may be linear or branched; $R_1$ and $R_2$ may contain other functional groups, including, —OH, —$NH_2$, and —CHO; and n is such that the molecular weight is up to about 5000.

In one embodiment, the polyalkylene glycol mono ethers each have a molecular weight of from about 300 up to about 1200.

In one embodiment, the polyalkylene glycol mono ethers are present in an amount of from about 1 wt % up to about 20 wt % of the composition.

In one embodiment, the base stock is a Group III or Group IV base stock, or a blend of Group III and/or Group IV base stocks.

In one embodiment, the kinematic viscosity at 100° C. of the composition is from about 3 cSt up to about 20 cSt.

In one embodiment, the method further comprises the step of adding one or more additives chosen from the group consisting of friction modifiers, antiwear additives, viscosity improvers, detergents, dispersants, antioxidants, anti-foam agents, demulsifiers, corrosion inhibitors, seal compatibility additives, antirust additives, and co-base stocks.

In one embodiment, the additives are present in an amount of up to about 20 wt % of the composition.

In one embodiment, the method further comprises the step of adding a co-base stock.

Preferably, the co-base stock is one or more chosen from the group consisting of esters and alkylated naphthalenes.

Preferably, the polyalkylene glycol mono ether is poly (oxyethylene)(4) lauryl ether.

Preferably, the pour point depressant is a polymethacrylate.

DETAILED DESCRIPTION

It has been discovered that when one of the OH groups of a polyalkylene glycol is capped with an R group, such as —$CH_3$, the solubility of the molecule in non-polar solvents, such as mineral and synthetic hydrocarbon-based base stocks, is significantly increased.

An example of such a single-capped polyalkylene glycol mono ether is poly(oxyethylene)(4) lauryl ether (Brij 30), represented by the formula:

$$C_{12}H_{25}(OCH_2CH_2)_4OH$$

which has a molecular weight of 362.6.

In accordance with the present invention, the single-capped polyalkylene glycols (i.e., polyalkylene glycol mono ethers) can be represented by the general formula:

$$R_1\text{-}[O(R_2)]_n\text{—}OH$$

wherein $R_1$=$C_1$ to $C_{12}$ (i.e., one carbon atom to 12 carbon atoms), and may be linear or branched; $R_2$=$C_1$ to $C_6$ (i.e., one carbon atom to six carbon atoms), and may be linear or branched; and n is such that the molecular weight is up to about 5000. $R_1$ and $R_2$ optionally include —OH, —$NH_2$, and/or —CHO functional groups. Exemplary embodiments can include those in which, $R_1$=$C_1$ to $C_{12}$, or $R_1$=$C_1$ to $C_{10}$, or $R_1$=$C_1$ to $C_8$, or $R_1$=$C_1$ to $C_6$, or $R_1$=$C_1$ to $C_4$, or $R_1$=$C_1$ to $C_2$, or $R_1$=$C_1$. Exemplary embodiments can also include those in which $R_2$=$C_1$ to $C_6$, or $R_2$=$C_1$ to $C_4$, or $R_2$=$C_1$ to $C_2$, or $R_2$=$C_1$. It is contemplated that the molecular weights of the polyalkylene glycol mono ethers can be up to about 5000, for example up to about 4000, up to about 3000, up to about 2000, up to about 1200, up to about 900, up to about 600, or up to about 400. Additionally or alternately, the molecular weight can be from at least about 40, at least about 100, at least about 200, or at least about 300.

In exemplary embodiments, preferably $R_1$ and $R_2$ can be different, e.g., $R_1$=$C_1$ and $R_2$=$C_2$, $R_1$=$C_4$ and $R_2$=$C_3$, and so on.

In other exemplary embodiments, $R_1$ and $R_2$ can be the same, e.g., $R_1$=$C_1$ and $R_2$=$C_1$, $R_1$=$C_2$ and $R_2$=$C_2$, $R_1$=$C_3$ and $R_2$=$C_3$, and so on.

Surprisingly, when both protons on the two OH groups were capped, the solubility of the product in hydrocarbons was diminished. An example of such a molecule is polyethylene glycol dimethyl ether which was insoluble in Group I, II, III and PAO base stocks under the same conditions as the mono ethers. Polyethylene glycol dimethyl ether is represented by the formula:

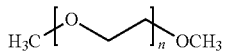

It has also been discovered that lubricating compositions comprising mineral and/or and synthetic hydrocarbon-based base stocks and polyalkylene glycol mono ethers provide solvency for additive packages, and unexpected improvements in average coefficient of friction, average wear scar, average film thickness, cam and lifter wear, and phosphorus retention.

Although lubricating compositions comprising mineral and/or and synthetic hydrocarbon-based base stocks and polyalkylene glycol mono ethers possess many improved properties, the addition of the polyalkylene glycol mono ether can have a detrimental effect on the pour point of the composition. As described herein, it has been discovered that the pour point of a lubricating composition containing polyalkylene glycol mono ethers can be improved (i.e., lowered) by premixing the polyalkylene glycol mono ether with a pour point depressant prior to blending together or admixing the premixed polyalkylene glycol mono ether and pour point depressant with the base stock.

Conventional pour point depressants (also known as lube oil flow improvers) may be used in accordance with the present inventions. These pour point depressants generally lower the minimum temperature at which the fluid will flow or can be poured. But, as explained herein, premixing the polyalkylene glycol mono ethers and pour point depressant unexpectedly provides even further reduction in pour point. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 wt %, preferably about 0.01 to 1.5 wt %, more preferably about 0.1 to 0.5 wt %.

Lubricating compositions prepared in accordance with the present inventions may additionally include an additive package comprising an effective amount of at least one additional performance enhancing additive, such as for example but not limited to at least one of a friction modifier, and/or a lubricity agent, and/or an antiwear agent, and/or extreme pressure additives, and/or a viscosity index (VI) improver, and/or a detergent, and/or a dispersant, and/or an antioxidant, and/or an antifoamant, and/or a demulsifier, and/or a corrosion inhibitor, and/or a seal swell control additive, and/or antiseizure agent, and/or dye, and/or metal deactivators, and/or antistaining agent, and/or a co-basestock. Of these, those additives common to most formulated lubricating oils include one or more friction modifiers, antiwear additives, detergents, dispersants, and antioxidants, with other additives being optional depending on the intended use of the oil. An effective amount of one or more additives, or an additive package containing one or more such additives, is added to, blended into or admixed with the base stock to meet one or more formulated product specifications, such as those relating to a lube oil for diesel engines, internal combustion engines, automatic transmissions, turbine or jet engines, as is known. For a review of many commonly used additives see: Klamann in "Lubricants and Related Products" Verlag Chemie, Deerfield Beach, Fla.: ISBN 0-89573-177-0. Reference is also made to "Lubricant Additives" by M. W. Ronney, published by Noyes Data Corporation, Parkridge, N.J. (1973). Various manufacturers sell such additive packages for adding to a base stock or to a blend of base stocks to form fully formulated lubricating oils for meeting performance specifications required for different applications or intended uses, and the exact identity of the various additives present in an additive package is typically maintained as a trade secret by the manufacturer. However, the chemical nature of the various additives is known to those skilled in the art.

The lubricating compositions of the present disclosure may use Group I, Group II or Group III base oil stocks, Group IV polyalphaolefin (PAO) base oil stocks, Group V base oil stocks, or any combination thereof. Useful Group I-III, Group IV PAO and Group V base stocks have a $Kv_{100}$ (kinetic viscosity at 100° C.) of greater than about 2 cSt to about 25 cSt. Groups I, II, III, IV and V are broad categories of base stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and less than about 90% saturates. Group II base stocks generally have a viscosity index of between about 80 to 120, and contain less than or equal to about 0.03% sulfur and greater than or equal to about 90% saturates. Group III stock generally has a viscosity index greater than about 120 and contains less than or equal to about 0.03% sulfur and greater than about 90% saturates. Group IV includes polyalphaolefins (PAO). Group V base stocks are base stocks not included in Groups I-IV. Table 1 summarizes properties of each of these five groups.

TABLE 1

Base Stock Properties

| | Saturates | Sulfur | Viscosity Index |
|---|---|---|---|
| Group I | <90% and/or | >0.03% and | ≥80 and <120 |
| Group II | ≥90% and | ≤0.03% and | ≥80 and <120 |
| Group III | ≥90% and | ≤0.03% and | ≥120 |
| Group IV | Polyalphaolefins (PAO) | | |
| Group V | All other base oil stocks not included in Groups I, II, III, or IV | | |

Manufacturing plants that make Group I base stocks typically use solvents to extract the lower viscosity index (VI) components and increase the VI of the crude to the desired specifications. These solvents are typically phenol or furfural. Solvent extraction gives a product with less than 90% saturates and more than 300 ppm sulfur. The majority of lube production in the world is in the Group I category.

Manufacturing plants that make Group II base stocks typically employ hydroprocessing such as hydrocracking or severe hydrotreating to increase the VI of the crude oil to the specifications value. The use of hydroprocessing typically increases the saturate content above 90% and reduces the sulfur below 300 ppm. Approximately 10% of the lube base oil production in the world is in the Group II category, and about 30% of U.S. production is Group II.

Group III base stocks are usually produced using a three-stage process involving hydrocracking an oil feed stock, such as vacuum gas oil, to remove impurities and to saturate all aromatics which might be present to produce highly paraffinic lube oil stock of very high viscosity index, subjecting the hydrocracked stock to selective catalytic hydrodewaxing which converts normal paraffins into branched paraffins by isomerization followed by hydrofinishing to remove any residual aromatics, sulfur, nitrogen or oxygenates.

The term Group III stocks as used in the present specification and appended claims also embrace non-conventional or unconventional base stocks and/or base oils which include one or a mixture of base stock(s) and/or base oil(s) derived from: (1) one or more Gas-to-Liquids (GTL) materials; as well as (2) hydrodewaxed, or hydroisomerized/cat (and/or solvent) dewaxed base stock(s) and/or base oil(s) derived from synthetic wax, natural wax or waxy feeds, waxy feeds including feeds such as mineral and/or non-mineral oil waxy feed stocks, for example gas oils, slack waxes (derived from the solvent dewaxing of natural oils, mineral oils or synthetic; e.g., Fischer-Tropsch feed stocks) and waxy stocks such as waxy fuels hydrocracker bottoms, waxy raffinate, hydrocrackate, thermal crackates, foots oil or other natural, mineral oil, or even non-petroleum oil derived waxy materials such as waxy materials recovered from coal liquefaction or shale oil, linear or branched hydrocarbyl compounds with carbon number of about 20 or greater, preferably about 30 or greater, and mixtures of such base stocks and/or base oils.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) include oils boiling in the lube oil boiling range separated/fractionated from GTL materials such as by, for example, distillation or thermal diffusion, and subsequently subjected to well-known catalytic or solvent dewaxing processes to produce lube oils of reduced/low pour point; wax isomerates, comprising, for example, hydroisomerized or isodewaxed synthesized hydrocarbons; hydroisomerized or isodewaxed Fischer-Tropsch ("F-T") material (i.e., hydrocarbons, waxy hydrocarbons, waxes and possible analogous oxygenates); preferably hydroisomerized or isodewaxed F-T hydrocarbons or hydroisomerized or isodewaxed F-T waxes, hydroisomerized or isodewaxed synthesized waxes, or mixtures thereof.

GTL base stock(s) derived from GTL materials, especially, hydroisomerized/isodewaxed F-T material derived base stock(s), and other hydroisomerized/isodewaxed wax derived base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about 4 $mm^2/s$ at 100° C. and a viscosity index of about 130 or greater. The term GTL base oil/base stock and/or wax isomerate base oil/base stock as used herein and in the claims is to be understood as embracing individual fractions of GTL base stock/base oil or wax isomerate base stock/base oil as recovered in the production process, mixtures of two or more GTL base stocks/base oil fractions and/or wax isomerate base stocks/base oil fractions, as well as mixtures of one or two or more low viscosity GTL base stock(s)/base oil fraction(s) and/or wax isomerate base stock(s)/base oil fraction(s) with one, two or more high viscosity GTL base stock(s)/base oil fraction(s) and/or wax isomerate base stock(s)/base oil fraction(s) to produce a bi-modal blend wherein the blend exhibits a viscosity within the aforesaid recited range. Reference herein to Kinematic Viscosity refers to a measurement made by ASTM method D445.

GTL base stocks derived from GTL materials, especially hydroisomerizedlisodewaxed F-T material derived base stock(s), and other hydroisomerizedlisodewaxed wax-derived base stock(s), such as wax hydroisomerates/isodewaxates, which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM D97 and similar automated versions.

The GTL base stock(s) derived from GTL materials, especially hydroisomerized/isodewaxed F-T material derived base stock(s), and other hydroisomerized/isodewaxed wax-derived base stock(s) which are base stock components which can be used in this invention are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) are typically highly paraffinic of greater than 90 percent saturates) and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks typically have very low sulfur and nitrogen content, generally containing less than about 10 ppm, and more typically less than about 5 ppm of each of these elements. The sulfur and nitrogen content of GTL base stock obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s), hydroisomerized or isodewaxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949 for example.

Base stock(s) derived from waxy feeds, which are also suitable for use as the Group III stocks in this invention, are paraffinic fluids of lubricating viscosity derived from hydrodewaxed, or hydroisomerized/cat (and/or solvent) dewaxed waxy feed stocks of mineral oil, non-mineral oil, non-petroleum, or natural source origin, e.g. feed stocks such as one or more of gas oils, slack wax, waxy fuels hydrocracker bottoms, hydrocarbon raffinates, natural waxes, hydrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stock(s).

Slack wax is the wax recovered from any waxy hydrocarbon oil including synthetic oil such as F-T waxy oil or petroleum oils by solvent or auto-refrigerative dewaxing. Solvent dewaxing employs chilled solvent such as methyl ethyl ketone (MEK), methyl isobutyl ketone (MIBK), mixtures of MEK/MIBK, mixtures of MEK and toluene, while auto-refrigerative dewaxing employs pressurized, liquefied low boiling hydrocarbons such as propane or butane.

Slack waxes secured from synthetic waxy oils such as F-T waxy oil will usually have zero or nil sulfur and/or nitrogen containing compound content. Slack wax(es) secured from petroleum oils, may contain sulfur and nitrogen-containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

The process of making the lubricant oil base stocks from wax or waxy stocks, e.g. slack wax, F-T wax or waxy feed, may be characterized as an isomerization process. As previously indicated, if slack waxes are used as the feed, they may need to be subjected to a preliminary hydrotreating step under conditions already well known to those skilled in the art to reduce (to levels that would effectively avoid poisoning or deactivating the isomerization catalyst) or to remove sulfur- and nitrogen-containing compounds which would otherwise deactivate the hydroisomerization or hydrodewaxing catalyst used in subsequent steps. If F-T waxes are used, such preliminary treatment is not required because such waxes have only trace amounts (less than about 10 ppm, or more typically less than about 5 ppm to nil each) of sulfur and/or nitrogen compound content. However, some hydrodewaxing catalyst feed F-T waxes may benefit from prehydrotreatment for the removal of oxygenates while others may benefit from oxygenates treatment. The hydroisomerization or hydrodewaxing process may be conducted over a combination of catalysts, or over a single catalyst.

Following any needed hydrodenitrogenation or hydrosulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

Conversion of the waxy feed stock may be conducted over a combination of Pt/zeolite beta and Pt/ZSM-23 catalysts or over such catalysts used in series in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over a catalyst comprising Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269.

A dewaxing step, when needed, may be accomplished using one or more of solvent dewaxing, catalytic dewaxing or hydrodewaxing processes or combinations of such processes in any sequence.

In solvent dewaxing, the hydroisomerate may be contacted with chilled solvents such as acetone, methyl ethyl ketone (MEK), methyl isobutyl ketone (MIBK), mixtures of ME/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Auto-refrigerative dewaxing using low molecular weight hydrocarbons, such as propane, can also be used in which the hydroisomerate is mixed with, e.g., liquid propane, at least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention.

In catalytic dewaxing the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials which are separated from the heavier base stock fraction. This base stock fraction can then be fractionated into two or more base stocks. Separation of the lower boiling material may be accomplished either prior to or during fractionation of the heavy base stock fraction material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPOs. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400 to 600° F., a pressure of 500 to 900 psig, $H_2$ treat rate of 1500 to 3500 SCF/B for flow-through reactors and LHSV of 0.1 to 10, preferably 0.2 to 2.0. The dewaxing is typically conducted to convert no more than 40 wt % and preferably no more than 30 wt % of the hydroisomerate having an initial boiling point in the range of 650 to 750° F. to material boiling below its initial boiling point.

Polyalpha olefin (PAO) base stocks may also be used in the present invention. PAOs in general are typically comprised of relatively low molecular weight hydrogenated polymers or oligomers of polyalphaolefins which include, but are not limited to, $C_2$ to about $C_{32}$ alphaolefins, with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins.

The PAO fluids may be conveniently made by the polymerization of one or a mixture of alphaolefins in the presence of a polymerization catalyst such as the Friedel-Crafts catalyst including, for example, aluminum trichloride, boron trifluoride or complexes of boron trifluoride with water, alcohols such as ethanol, propanol or butanol, carboxylic acids or esters such as ethyl acetate or ethyl proprionate. For example, the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330. PAOs useful in the present invention may have a kinematic viscosity at 100° C. from about 1.5 to about 5,000 cSt ($mm^2/s$). For the purposes of this invention the PAO preferably has a kinematic viscosity at 100° C. from about 2 to about 25 cSt ($mm^2/s$), from about 2 to about 20 cSt, or from about 2 to about 15 cSt. PAOs are often identified by reference to their approximate kinematic viscosity at 100° C. For example, PAO 6 refers to a PAO with a kinematic viscosity of approximately 6 cSt at 100° C.

The PAOs useful in the present invention can also be made by metallocene catalysis. The metallocene-catalyzed PAO (mPAO) can be a copolymer made from at least two or more different alphaolefins, or a homo-polymer made from a single alphaolefin feed employing a metallocene catalyst system.

The metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion. mPAO and methods for producing mPAO employing metallocene catalysis are described in WO 2007/011832 and U.S. published application 2009/0036725.

The copolymer mPAO composition is made from at least two alphaolefins of $C_3$ to $C_{30}$ range and having monomers randomly distributed in the polymers. It is preferred that the average carbon number is at least 4.1. Advantageously, ethylene and propylene, if present in the feed, are present in the amount of less than 50 wt % individually or preferably less than 50 wt % combined. The copolymers can be isotactic, atactic, syndiotactic polymers or any other form of appropriate taciticity.

mPAO can also be made from mixed feed Linear Alpha Olefins (LAOs) comprising at least two and up to 26 different linear alphaolefins selected from $C_3$ to $C_{30}$ linear alphaolefins. The mixed feed LAO can be obtained, for example, from an ethylene growth processing using an aluminum catalyst or a metallocene catalyst. The growth olefins comprise mostly $C_6$ to $C_{18}$ LAO. LAOs from other processes can also be used.

The homo-polymer mPAO composition can be made from single alphaolefin chosen from alphaolefins in the $C_3$ to $C_{30}$ range, preferably $C_3$ to $C_{16}$, most preferably $C_3$ to $C_{14}$ or $C_3$ to $C_{12}$. The homo-polymers can be isotactic, atactic, syndiotactic polymers or any other form of appropriate taciticity. The taciticity can be carefully tailored by the polymerization catalyst and polymerization reaction condition chosen or by the hydrogenation condition chosen.

The alphaolefin(s) can be chosen also from any component from a conventional LAO production facility or from a refinery. It can be used alone to make homo-polymer or together with another LAO available from a refinery or chemical plant, including propylene, 1-butene, 1-pentene, and the like, or with 1-hexene or 1-octene made from a dedicated production facility. The alphaolefins also can be chosen from the alphaolefins produced from Fischer-Tropsch synthesis (as reported in U.S. Pat. No. 5,382,739). For example, $C_3$ to $C_{16}$ alphaolefins, more preferably linear alphaolefins, are suitable to make homo-polymers. Other combinations, such as $C_4$- and $C_{14}$-LAO, $C_6$- and $C_{16}$-LAO, $C_8$-, $C_{10}$-, $C_{12}$-LAO, or $C_8$- and $C_{14}$-LAO, $C_6$-, $C_{10}$-, $C_{14}$-LAO, $C_4$- and $C_{12}$-LAO, etc., are suitable to make copolymers.

A feed comprising a mixture of LAOs selected from $C_3$ to $C_{30}$ LAOs or a single LAO selected from $C_3$ to $C_{16}$ LAO, is contacted with an activated metallocene catalyst under oligomerization conditions to provide a liquid product suitable for use in lubricant components or as functional fluids. Also embraced are copolymer compositions made from at least two alphaolefins of $C_3$ to $C_{30}$ range and having monomers randomly distributed in the polymers. The phrase "at least two alphaolefins" will be understood to mean "at least two different alphaolefins" (and similarly "at least three alphaolefins" means "at least three different alphaolefins", and so forth).

The product obtained is an essentially random liquid copolymer comprising the at least two alphaolefins. By "essentially random" is meant that one of ordinary skill in the art would consider the products to be random copolymer. Likewise the term "liquid" will be understood by one of ordinary skill in the art as meaning liquid under ordinary conditions of temperature and pressure, such as ambient temperature and pressure.

The process for producing mPAO employs a catalyst system comprising a metallocene compound (Formula 1, below) together with an activator such as a non-coordinating anion (NCA) (Formula 2, below) or methylaluminoxane (MAO) 1111 (Formula 3, below):

Formula 1

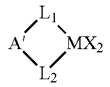

Formula 2

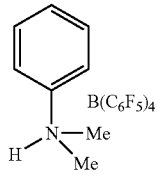

NCA

Formula 3

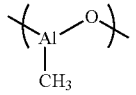

MAO

The term "catalyst system" is defined herein to mean a catalyst precursor/activator pair, such as a metallocene/activator pair. When "catalyst system" is used to describe such a pair before activation, it means the unactivated catalyst (precatalyst) together with an activator and, optionally, a co-activator (such as a trialkyl aluminum compound). When it is used to describe such a pair after activation, it means the activated catalyst and the activator or other charge-balancing moiety. Furthermore, this activated "catalyst system" may optionally comprise the co-activator and/or other charge-balancing moiety. Optionally and often, the co-activator, such as trialkyl aluminum compound, is also used as an impurity scavenger.

The metallocene is selected from one or more compounds according to Formula 1 above. In Formula 1, M is selected from Group 4 transition metals, preferably zirconium (Zr), hafnium (Hf) and titanium (Ti), L1 and L2 are independently selected from cyclopentadienyl ("Cp"), indenyl, and fluorenyl, which may be substituted or unsubstituted, and which may be partially hydrogenated. A is an optional bridging group which, if present, can be selected from dialkylsilyl, dialkylmethyl, diphenylsilyl or diphenylmethyl, ethylenyl ($—CH_2—CH_2$), alkylethylenyl ($—CR_2—CR_2$), where alkyl can be independently $C_1$ to $C_{16}$ alkyl radical or phenyl, tolyl, xylyl radical and the like, and wherein each of the two X groups, Xa and Xb, are independently selected from halides OR(R is an alkyl group, preferably selected from $C_1$ to $C_5$ straight or branched chain alkyl groups), hydrogen, $C_1$ to $C_{16}$ alkyl or aryl groups, haloalkyl, and the like. Usually relatively more highly substituted metallocenes give higher catalyst productivity and wider product viscosity ranges.

The polyalphaolefins preferably have a Bromine number of 1.8 or less as measured by ASTM D1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less. If necessary the polyalphaolefins can be hydrogenated to achieve a low bromine number.

The mpolyalphaolefins (mPAO) described herein may have monomer units represented by Formula 4 in addition to the all regular 1,2-connection:

Formula 4

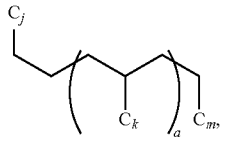

where j, k and m are each, independently, 3, 4, 5, 6, 7, 8, 9, 10, 11, 12, 13, 14, 15, 16, 17, 18, 19, 20, 21 or 22, n is an integer from 1 to 350 (preferably 1 to 300, preferably 5 to 50) as measured by proton NMR.

Any of the mpolyalphaolefins (mPAO) described herein may have an Mw (weight average molecular weight) of 100,000 or less, preferably between 100 and 80,000, preferably between 250 and 60,000, preferably between 280 and 50,000, preferably between 336 and 40,000 g/mol.

Any of the mpolyalphaolefins (mPAO) described herein may have a Mn (number average molecular weight) of 50,000 or less, preferably between 200 and 40,000, preferably between 250 and 30,000, preferably between 500 and 20,000 g/mol.

Any of the mpolyalphaolefins (mPAO) described herein may have a molecular weight distribution (MWD-Mw/Mn) of greater than 1 and less than 5, preferably less than 4, preferably less than 3, preferably less than 2.5. The MWD of mPAO is always a function of fluid viscosity. Alternately, any of the polyalphaolefins described herein may have an Mw/Mn of between 1 and 2.5, alternately between 1 and 3.5, depending on fluid viscosity.

Molecular weight distribution (MWD), defined as the ratio of weight-averaged MW to number-averaged MW (=Mw/Mn), can be determined by gel permeation chromatography (GPC) using polystyrene standards, as described in p. 115 to 144, Chapter 6, The Molecular Weight of Polymers in "Principles of Polymer Systems" (by Ferdinand Rodrigues, McGraw-Hill Book, 1970). The GPC solvent was HPLC Grade tetrahydrofuran, uninhibited, with a column temperature of 30° C., a flow rate of 1 nil/min, and a sample concentration of 1 wt %, and the Column Set is a Phenogel 500 A, Linear, 10E6A.

Any of the m-polyalphaolefins (mPAO) described herein may have a substantially minor portion of a high end tail of the molecular weight distribution. Preferably, the mPAO has not more than 5.0 wt % of polymer having a molecular weight of greater than 45,000 Daltons. Additionally or alternately, the amount of the mPAO that has a molecular weight greater than 45,000 Daltons is not more than 1.5 wt %, or not more than 0.10 wt %. Additionally or alternately, the amount of the mPAO that has a molecular weight greater than 60,000 Daltons is not more than 0.5 wt %, or not more than 0.20 wt %, or not more than 0.1 wt %. The mass fractions at molecular weights of 45,000 and 60,000 can be determined by GPC, as described above.

Any mPAO described herein may have a pour point of less than 0° C. (as measured by ASTM D97), preferably less than −10° C., preferably less than −20° C., preferably less than −25° C., preferably less than −30° C., preferably less than −35° C., preferably less than −50° C., preferably between −10° C. and −80° C., preferably between −15° C. and −70° C.

mPolyalphaolefins (mPAO) made using metallocene catalysis may have a kinematic viscosity at 100° C. from about 1.5 to about 5,000 cSt ($mm^2/s$). For the purposes of this invention the mPAO preferably has a kinematic viscosity at 100° C. from about 2 to about 25 cSt ($mm^2/s$), from about 2 to about 20 cSt, or from about 2 to about 15 cSt.

The lubricating compositions of the present disclosure may also contain additional additives, as described below. The use of polyalkylene glycol mono ethers greatly improves the solubility of additives in formulated lubricant compositions when compared to the solubility of additives when using polyalkylene glycols which are not single-capped. The lubricant compositions, however, are not limited by the examples shown herein as illustrations.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc. See U.S. Pat. Nos. 5,824,627; 6,232,276; 6,153,564; 6,143,701; 6,110,878; 5,837,657; 6,010,987; 5,906,968; 6,734,150; 6,730,638; 6,689,725; 6,569,820; WO 99/66013; WO 99/47629; WO 98/26030.

Ashless friction modifiers may include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 wt % to 10-15 wt % or more, often with a preferred range of about 0.1 wt % to 5 wt %. Concentrations of molybdenum-containing materials are often described in terms of Mo metal concentration. Advantageous concentrations of Mo may range from about 10 ppm to 3000 ppm or more, and often with a preferred range of about 20-2000 ppm, and in some instances a more preferred range of about 30-1000 ppm. Friction modifiers of all types may be used alone or in mixtures with the materials of this invention. Often mixtures of two or more friction modifiers, or mixtures of friction modifier(s) with alternate surface active material(s), are also desirable.

Antiwear and EP Additives

Many lubricating oils require the presence of antiwear and/or extreme pressure (EP) additives in order to provide adequate antiwear protection for the engine. Increasingly specifications for engine oil performance have exhibited a trend for improved antiwear properties of the oil. Antiwear and extreme EP additives perform this role by reducing friction and wear of metal parts.

While there are many different types of antiwear additives, for several decades the principal antiwear additive for internal combustion engine crankcase oils is a metal alkylthiophosphate and more particularly a metal dialkyldithiophosphate in which the primary metal constituent is zinc, or zinc dialkyldithiophosphate (ZDDP). ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lube oil composition, although more or less can often be used advantageously.

However, it is found that the phosphorus from these additives has a deleterious effect on the catalyst in catalytic converters and also on oxygen sensors in automobiles. According to one aspect of this invention, as discussed below in connection with the Examples, the use of polyalkylene glycol mono ethers results in unexpected improvements in phosphorus retention.

Another way to minimize this effect is to replace some or all of the ZDDP with phosphorus-free antiwear additives.

A variety of non-phosphorous additives are also used as antiwear additives. Sulfurized olefins are useful as antiwear and EP additives. Sulfur-containing olefins can be prepared by sulfurization or various organic materials including aliphatic, arylaliphatic or alicyclic olefinic hydrocarbons containing from about 3 to 30 carbon atoms, preferably 3-20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of $R^3$-$R^6$ may be connected so as to form a cyclic ring. Additional information concerning sulfurized olefins and their preparation can be found in U.S. Pat. No. 4,941,984.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithiocarbamate trimer complex (R=$C_8$-$C_{18}$ alkyl) are also useful antiwear agents. The use or addition of such materials should be kept to a minimum if the object is to produce low SAP formulations.

Esters of glycerol may be used as antiwear agents. For example, mono-, di-, and tri-oleates, mono-palmitates and mono-myristates may be used.

ZDDP is combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties.

Preferred antiwear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics, for example dimercaptothiadiazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP formulations.

Viscosity Improvers

Viscosity improvers (also known as Viscosity Index modifiers, and VI improvers) provide lubricants with high and low temperature operability. These additives increase the viscosity of the oil composition at elevated temperatures which increases film thickness, while having limited effect on viscosity at low temperatures.

Suitable viscosity improvers include high molecular weight hydrocarbons, polyesters and viscosity index improver dispersants that function as both a viscosity index improver and a dispersant. Typical molecular weights of these polymers are between about 1,000 to 1,000,000, more typically about 2,000 to 500,000, and even more typically between about 25,000 and 100,000.

Examples of suitable viscosity improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

The amount of viscosity modifier may range from 0.01 to 8 wt %, preferably 0.01 to 4 wt %, more preferably 0.01 to 2 wt % based on active ingredient and depending on the specific viscosity modifier used.

Detergents

Detergents are commonly used in lubricating compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stoichiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Klamann in Lubricants and Related Products, op cit discloses a number of overbased metal salts of various sulfonic acids which are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

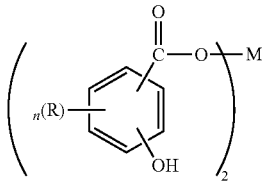

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction. See U.S. Pat. No. 3,595,791 for additional information on synthesis of these compounds. The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039, for example.

Preferred detergents include calcium phenates, calcium sulfonates, calcium salicylates, magnesium phenates, magnesium sulfonates, magnesium salicylates and other related components (including borated detergents). Typically, the total detergent concentration is about 0.01 to about 8.0 wt %, preferably, about 0.1 to 4.0 wt %.

Dispersants

During machinery operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433; 3,822,209 and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cit, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols, arylamines. These antioxidants may be used individually by type or in combination with one another. Such additives may be used in an amount of about 0.01 to 5 wt %, preferably about 0.01 to 1.5 wt %, more preferably zero to less than 1.5 wt %, most preferably zero.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent and often less than 0.1 percent.

Corrosion Inhibitors

Corrosion inhibitors are used to reduce the degradation of metallic parts that are in contact with the lubricating oil composition. Suitable corrosion inhibitors include thiadiazoles. See, for example, U.S. Pat. Nos. 2,719,125; 2,719,126; and 3,087,932. Such additives may be used in an amount of about 0.01 to 5 wt %, preferably about 0.01 to 1.5 wt %.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %.

Inhibitors and Antirust Additives

Antirust additives (or corrosion inhibitors) are additives that protect lubricated metal surfaces against chemical attack by water or other contaminants. A wide variety of these are commercially available; they are referred to in Klamann in Lubricants and Related Products, op cit.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt %.

Co-Basestocks

In lubricating oil compositions of the present invention in which the base stock is a Group I, Group II, Group III or Group IV base stock, or combination thereof, the lubricating oil compositions may also include one or more co-base stocks which provide further increased solubility of the polyalkylene glycol mono ethers and additives in the Group I, Group II, Group III and/or Group IV base stock.

Esters comprise a useful co-basestock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those full or partial esters which are obtained by reacting one or more polyhydric alcohols (preferably the hindered polyols such as the neopentyl polyols e.g. neopentyl glycol, trimethylol ethane, 2-methyl-2-propyl-1,3-propanediol, trimethylol propane, pentaerythritol and dipentaerythritol) with alkanoic acids containing at least about 4 carbon atoms (preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid).

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms.

Alkylated naphthalenes are also a useful co-basestock. The alkyl groups on the alkylated naphthalene preferably have from about 6 to 30 carbon atoms, with particular preference to about 12 to 18 carbon atoms. A preferred class of alkylating agents are the olefins with the requisite number of carbon atoms, for example, the hexenes, heptenes, octenes, nonenes, decenes, undecenes, dodecenes. Mixtures of the olefins, e.g. mixtures of $C_{12}$-$C_{20}$ or $C_{14}$-$C_{18}$ olefins, are useful. Branched alkylating agents, especially oligomerized olefins such as the trimers, tetramers, pentamers, etc., of light olefins such as ethylene, propylene, the butylenes, etc., are also useful.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 2 below.

Note that many of the additives are shipped from the manufacturer and used with a certain amount of base oil solvent in the formulation. Accordingly, the weight amounts in the table below, as well as other amounts mentioned in this text, unless otherwise indicated are directed to the amount of active ingredient (that is the non-solvent portion of the ingredient). The wt % indicated below are based on the total weight of the lubricating oil composition.

TABLE 2

Typical Amounts of Various Lubricant Oil Components

| Compound | Approximate wt % (useful) | Approximate wt % (preferred) |
|---|---|---|
| Friction Modifiers | 0.01-15 | 0.01-5 |
| Antiwear Additives | 0.01-6 | 0.01-4 |
| Viscosity Improvers | 0.01-8 | 0.01-2 |
| Detergents | 0.01-8 | 0.01-4 |
| Dispersants | 0.1-20 | 0.1-8 |
| Antioxidants | 0.01-5 | 0.01-1.5 |
| Pour Point Depressants | 0.01-5 | 0.01-1.5 |
| Anti-foam Agents | 0.001-1 | 0.001-0.1 |
| Corrosion Inhibitors | 0.01-5 | 0.01-1.5 |
| Co-basestocks | 0-50 | 0-40 |
| Base Stocks | Balance | Balance |

Lubricating compositions of the present disclosure are prepared by premixing one or more polyalkylene glycol mono ethers with one or more pour point depressants and then blending together or admixing the premixed polyalkylene glycol mono ether(s) and pour point depressant(s) with one or more base stocks from the group consisting of Group I, Group II, Group III, Group IV, and Group V base stocks, and optionally one or more additional additives.

The lubricating compositions can be used as automotive engine lubricants and commercial vehicle engine lubricants. The lubricating compositions demonstrate superior performance with regard to average friction coefficient, average wear scar, average film thickness, cam and lifter wear, and phosphorus retention when compared to similar compositions that do not contain polyalkylene glycol mono ethers. The lubricating compositions also demonstrate improved (i.e., lowered) pour points compared to compositions in which the polyalkylene glycol mono ethers and pour points were not premixed prior to blending with the base stocks. The lubricating compositions can also be used as industrial lubricants.

In the lubricating compositions, the base stock can be Group I, Group II, Group III, Group IV, or Group V, or any combination of these base stocks. These base stocks, or combinations of these base stocks can be used in the lubricating compositions in amounts of up to about 99 wt % of the composition, up to about 95 wt % of the composition, up to about 90 wt % of the composition, up to about 80 wt % of the composition, up to about 70 wt % of the composition, up to about 60 wt % of the composition, up to about 50 wt % of the composition, or up to about 40 wt % of the composition. Additionally or alternately, the base stocks can be used in the lubricating compositions in amounts of at least about 40 wt % of the composition, at least about 50 wt % of the composition, at least about 60 wt % of the composition, at least about 70 wt % of the composition, at least about 80 wt % of the composition, at least about 90 wt % of the composition, or at least about 95 wt % of the composition. Further additionally or alternately, the base stocks can be used in the lubricating compositions in amounts of from about 40 wt % of the composition to about 99 wt % of the composition, from about 50 wt % of the composition to about 99 wt % of the composition, from about 60 wt % of the composition to about 99 wt % of the composition, from about 70 wt % of the composition to about 99 wt % of the composition, from about 75 wt % of the composition to about 99 wt % of the composition, from about 75 wt % of the composition to about 95 wt % of the composition, or from about 75 wt % of the composition to about 85 wt % of the composition.

In the lubricating compositions, the Group I, Group II, Group III, Group IV and Group V base stocks, or combinations of these base stocks, can have a kinematic viscosity at 100° C. of up to about 25 cSt, up to about 20 cSt, up to about 15 cSt, up to about 12 cSt, up to about 10 cSt, up to about 8 cSt, or up to about 6 cSt. Additionally or alternately, the Group I, Group II, Group III, Group IV and Group V base stocks, or combinations of these base stocks, can have a kinematic viscosity at 100° C. of at least about 2 cSt, at least about 4 cSt, or at least about 6 cSt. Further additionally or alternately, the Group I, Group II, Group III, Group IV and Group V base stocks, or combinations of these base stocks, can have a kinematic viscosity at 100° C. of from about 2 cSt to about 25 cSt, from about 2 cSt to about 15 cSt, from about 2 cSt to about 12 cSt, from about 3 cSt to about 10 cSt, or from about 3 cSt to about 8 cSt.

In the lubricating compositions, the polyalkylene glycol mono ethers can be used in an amount of up to about 60 wt %, up to about 50 wt % of the composition, up to about 40 wt % of the composition, up to about 30 wt % of the composition, up to about 20 wt % of the composition, up to about 15 wt % of the composition, up to about 10 wt % of the composition, up to about 5 wt % of the composition, or up to about 3 wt % of the composition. Additionally or alternately, the polyalkylene glycol mono ethers can be used in an amount of from about 0.5 wt %, from about 1 wt % of the composition, from about 2 wt % of the composition, from about 5 wt % of the composition, or from about 10 wt % of the composition. Further additionally or alternately, the polyalkylene glycol mono ethers can be used in an amount of from about 1 to about 25 wt % of the composition, or from about 1 to about 15 wt % of the composition, or from about 1 to about 5 wt % of the composition, from about 5 to about 25 wt % of the composition, or from about 10 to about 20 wt % of the composition.

The pour points of the lubricating compositions were measured according to the ASTM D97 standard. In an embodiment of the present invention, the pour point of the lubricating composition is reduced by at least 5° C. when the polyalkylene glycol mono ether and pour point depressant are premixed, compared to when they are not premixed. Additionally or alternately, the pour point is reduced by at least 7° C., or by at least 9° C., or by at least 11° C.

In an embodiment of the present invention, at least one additional additive is blended into or admixed in lubricating compositions. In one embodiment, at least one friction modifier is added. Additionally or alternately, at least one antiwear and/or extreme pressure (EP) additive is added. In a further embodiment of the lubricating compositions, the additives are present in an amount of up to about 30 wt % of the composition, up to about 25 wt % of the composition, up to about 20 wt % of the composition, up to about 15 wt % of the composition, up to about 10 wt % of the composition, or up to about 5 wt % of the composition.

The kinematic viscosities at 40° C. of the lubricating compositions were measured according to the ASTM D445 standard. Preferably, the lubricating compositions have a kinematic viscosity at 40° C. of from about 12 cSt to about 50 cSt, or from about 14 cSt to about 20 cSt.

The kinematic viscosities at 100° C. of the lubricating compositions were measured according to the ASTM D445 standard. Preferably, the lubricating compositions have a kinematic viscosity at 100° C. of up to about 25 cSt, up to about 20 cSt, up to about 15 cSt, up to about 12 cSt, up to about 10 cSt, up to about 8 cSt, or up to about 6 cSt. Additionally or alternately, the lubricating compositions have a kinematic viscosity at 100° C. of at least about 2 cSt, at least about 4 cSt, or at least about 6 cSt. Further additionally or alternately, the lubricating compositions have a kinematic viscosity at 100° C. of from about 2 cSt to about 25 cSt, from about 2 cSt to about 15 cSt, from about 2 cSt to about 12 cSt, from about 3 cSt to about 10 cSt, or from about 3 cSt to about 8 cSt.

The invention will now be more particularly described with reference to the following non-limiting Examples.

EXAMPLES

Example 1

A series of lubricating compositions were prepared with the compositions shown in Table 3. In Comparative Examples 1 and 4, Visom 4 (available from Exxon Mobil Corp.) and Brij 30 (available from Sigma-Aldrich Co.) were blended together in the amounts indicated by heating to 60° C. with stirring for 60 minutes. In Comparative Examples 2, 3, 5 and 6, Viscoplex 1-3103, a polymethacrylate-type pour point depressant (available from Evonik Industries), was added to the Visom 4/Brij 30 blends of Comparative Examples 1 and 4 in the amounts indicated by heating to 60° C. with stirring for 60 minutes. In Inventive Examples 1 and 2, Brij 30 was premixed with the pour point depressant by heating to 60° C. with stirring for 45 minutes. The Brij 30/pour point depressant mixture was then blended with Visom 4 by heating to 60° C. with stirring for 60 minutes. For each example, pour points were measured in accordance with ASTM D97, and kinematic viscosities at 40° C. and 100° C. were measured in accordance with ASTM D445.

The results in Table 3 showed that the addition of Brij 30 in the amounts of 2.0 wt % and 5.0 wt % to Visom 4 had a negative impact (i.e., increase) on pour point, from −24° C. (Visom 4 alone) to −12° C. (Comparative Ex. 1) and 3° C. (Comparative Ex. 4). The subsequent addition of a pour point depressant in the amount of 0.3 wt % (i.e., an amount typically used in formulated oils) to the Visom 4/Brij 30 blends of Comparative Examples 1 and 4 had limited or no impact on the pour point. In Comparative Example 2, the addition of 0.3 wt % pour point depressant to Comparative Example 1 (2.0 wt % Brij 30) resulted in a decrease in pour point from −12° C. to −24° C. In Comparative Example 5, the addition of 0.3 wt % pour point depressant to Comparative Example 4 (5.0 wt % Brij 30) resulted in no change in pour point—it remained at 3° C.

Surprisingly, it was discovered that when Brij 30 and the pour point depressant are premixed prior to their addition to the base stock (Visom 4), the pour point of the composition was significantly improved (i.e., lowered) compared to when Brij 30 and the pour point depressant were not premixed. As shown in Inventive Example 1, premixing Brij 30 and the pour point depressant results in a pour point of −31° C. for the composition, which is significantly lower than the −24° C. pour point of Comparative Example 2, even though the compositions of the two examples are the same. Inventive Example 2 also shows a significant improvement in pour point when Brij 30 and the pour point depressant are premixed. Inventive Example 2 has a pour point of −9° C., compared to 3° C. for Comparative Example 5, which has the same composition, but was not prepared by premixing Brij 30 and the pour point depressant. The improvements in the pour points of Inventive Examples 1 and 2 were equivalent to or better than doubling the amount of pour point depressant to 0.6 wt %, but without premixing. Comparative Example 3 resulted in a pour point of −30° C., which is slightly higher than Inventive Example 1 (−31° C.). Comparative Example 6 resulted in a pour point of −9° C., which was the same as Inventive Example 2.

TABLE 3

| Blend | Visom 4 | Brij 30 | Comp. Ex. 1 | Comp. Ex. 2 | Inventive Ex. 1 (Premix) | Comp. Ex. 3 | Comp. Ex. 4 | Comp. Ex. 5 | Inventive Ex. 2 (Premix) | Comp. Ex. 6 |
|---|---|---|---|---|---|---|---|---|---|---|
| Visom 4, wt % | 100 | 0.0 | 98.0 | 97.7 | 97.7 | 97.4 | 95.0 | 94.7 | 94.7 | 94.4 |
| Brij 30, wt % | 0.0 | 100 | 2.0 | 2.0 | 2.0 | 2.0 | 5.0 | 5.0 | 5.0 | 5.0 |
| Viscoplex 1-3103, wt % | 0.0 | 0.0 | 0.0 | 0.3 | 0.3 | 0.6 | 0.0 | 0.3 | 0.3 | 0.6 |
| Pour Point, ° C. (ASTM D97) | −24 | 0 | −12 | −24 | −31 | −30 | 3 | 3 | −9 | −9 |
| Kinematic viscosity at 40° C., cSt (ASTM D445) | 16.1 | 18.7 | 15.8 | 16.1 | 15.9 | 17.6 | 15.6 | 15.9 | 15.8 | 17.3 |
| Kinematic viscosity at 100° C., cSt (ASTM D445) | 3.9 | 4.2 | 3.9 | 3.9 | 3.9 | 4.2 | 3.9 | 3.9 | 3.9 | 4.1 |

What is claimed is:

1. A method of improving the pour point of a lubricating composition comprising a Group III base stock, one or more polyalkylene glycol mono ethers and one or more polymethyacrylate pour point depressants, comprising the step of:

premixing at least one polyalkylene glycol mono ether with at least one pour point depressant prior to blending the premixed polyalkylene glycol mono ethers and pour point depressants with the base stock, wherein the one or more polyalkylene glycol mono ethers constitutes from 2.0 to 5.0 wt. % of the lubricating composition and is poly(oxyethlene)(4)laurl ether represented by the formula $C_{12}H_{25}(OCH_2CH^2)_4OH$, wherein the one or more polymethyacrylate pour point depressants constitutes about 0.3 wt. % of the lubricating composition, and wherein the pour point of the lubricating composition is lowered by from 7 to 12° C. relative to the same lubricating composition without said premixing step.

2. The method of claim 1, wherein the Group III base stock constitutes from 94.7 to 97.7 wt % of the lubricating composition.

3. The method of claim 1, wherein the kinematic viscosity at 100° C. of the composition is from about 3 cSt up to about 20 cSt.

4. The method of claim 1, further comprising the step of adding one or more additives chosen from the group consisting of friction modifiers, antiwear additives, viscosity improvers, detergents, dispersants, antioxidants, anti-foam agents, demulsifiers, corrosion inhibitors, seal compatibility additives, antirust additives, and co-base stocks.

5. The method of claim 4, wherein the additives are present in an amount of up to about 20 wt % of the composition.

6. The method of claim 1, further comprising the step of adding a co-base stock.

7. The method of claim 6, wherein the co-base stock is one or more chosen from the group consisting of esters and alkylated naphthalenes.

* * * * *